US009685279B2

(12) United States Patent
Morimoto

(10) Patent No.: US 9,685,279 B2
(45) Date of Patent: Jun. 20, 2017

(54) SWITCH

(75) Inventor: Masaru Morimoto, Shiga (JP)

(73) Assignee: OMRON Corporation, Kyoto (JP)

( * ) Notice: Subject to any disclaimer, the term of this patent is extended or adjusted under 35 U.S.C. 154(b) by 118 days.

(21) Appl. No.: 14/346,415

(22) PCT Filed: Mar. 15, 2012

(86) PCT No.: PCT/JP2012/056656

§ 371 (c)(1),
(2), (4) Date: Apr. 28, 2014

(87) PCT Pub. No.: WO2013/054556

PCT Pub. Date: Apr. 18, 2013

(65) Prior Publication Data

US 2014/0231237 A1 Aug. 21, 2014

(30) Foreign Application Priority Data

Oct. 14, 2011 (JP) ..... 2011-227125

(51) Int. Cl.
*H01H 1/44* (2006.01)
*H01H 1/36* (2006.01)
(Continued)

(52) U.S. Cl.
CPC ..... *H01H 1/365* (2013.01); *H01H 1/40* (2013.01); *H01H 1/44* (2013.01); *H01H 3/04* (2013.01);
(Continued)

(58) Field of Classification Search
CPC ..... H01H 19/03; H01H 19/10; H01H 21/24; G06F 3/03548
(Continued)

(56) References Cited

U.S. PATENT DOCUMENTS 3,027,435 A 3/1962 Shlesinger, Jr.
2003/0094360 A1 5/2003 Nishimura et al.
(Continued)

FOREIGN PATENT DOCUMENTS

CN 1417822 A 5/2003
CN 101059732 A 10/2007
(Continued)

OTHER PUBLICATIONS

Xiamen Lizhou Hardware Spring Co. "High quality stainless steel bellow spring" p. 1 (no date).*
(Continued)

*Primary Examiner* — Edwin A. Leon
*Assistant Examiner* — Ahmed Saeed
(74) *Attorney, Agent, or Firm* — Osha Liang LLP

(57) ABSTRACT

A switch has a base comprising a flat circular recess formed on an upper surface thereof, a fixed contact disposed in an inner surface of the flat circular recess, a spring body that has a bellows shape in which a reference form unit is repetitively formed, the spring body being annularly disposed in the flat circular recess of the base, an operating body that has a turning unit fitted turnably in the flat circular recess of the base, and an operating projection provided in an inward surface of the turning unit. When the operating body is turned, the operating projection presses an end portion of the spring body to compress the spring body, which allows a contact to be switched.

20 Claims, 12 Drawing Sheets

(51) Int. Cl.

| | |
|---|---|
| ***H01H 21/36*** | (2006.01) |
| ***H01H 3/38*** | (2006.01) |
| ***H01H 3/04*** | (2006.01) |
| ***H01H 1/40*** | (2006.01) |
| *H01H 21/44* | (2006.01) |

(52) U.S. Cl.
CPC ..... *H01H 3/38* (2013.01); *H01H 21/36* (2013.01); *H01H 21/44* (2013.01)

(58) Field of Classification Search
USPC ..... 200/11 TW, 557, 17 R, 80 R, 559, 553, 200/332, 570
See application file for complete search history.

(56) References Cited

U.S. PATENT DOCUMENTS

| | | | | |
|---|---|---|---|---|
| 2007/0247423 | A1 | 10/2007 | Harley et al. | |
| 2008/0099321 | A1* | 5/2008 | Kiyono ..... | H01H 21/24 200/557 |
| 2010/0225619 | A1 | 9/2010 | Soumi | |
| 2011/0315531 | A1* | 12/2011 | Wong ..... | H01H 19/52 200/293 |

FOREIGN PATENT DOCUMENTS

| | | | |
|---|---|---|---|
| CN | 102007560 | A | 4/2011 |
| JP | 59-59430 | U | 4/1984 |
| JP | H1167011 | A | 3/1999 |
| JP | 2002-133976 | A | 5/2002 |
| JP | 2004-362979 | A | 12/2004 |
| JP | 2009-081082 | A | 4/2009 |
| JP | 2011-100626 | A | 5/2011 |

OTHER PUBLICATIONS

Extended European Search Report issued in corresponding European Application No. 12839399.8, mailed on Jun. 15, 2015 (7 pages).
International Search Report issued in PCT/JP2012/056656 mailed on Jun. 12, 2012 (4 pages).
Examination Report issued in corresponding Chinese Application No. 201280046819.0, mailed on Jun. 24, 2015 (10 pages).
Second Office Action issued in corresponding Chinese Application No. 201280046819.0, mailed on Jan. 21, 2016 (15 pages).

* cited by examiner

SWITCH

BACKGROUND

Technical Field

The present invention relates to a low-profile switch having the decreased number of components.

Related Art

Conventionally, as a switch, there is a switch device including a rotary handle body that includes an annular rotary shaft body and an operating body projecting from outer circumferential surface of the rotary shaft body, a device body, a movable contact spring, a pair of fixed contact units, and a substantially annular spring body. In the switch device, the device body includes first and second switch terminals electrically connected to the fixed contact units, respectively, and a common terminal to which the movable contact spring is electrically connected (see Patent Document 1).

Patent Document 1: Japanese Unexamined Patent Publication No. 2004-362979

SUMMARY

However, only use of a coil spring as the substantially annular spring body is disclosed in the switch device, and there is a limit to a low profile. Additionally, because not only the substantially annular spring body but also the movable contact spring are required, unfortunately the number of components and assembly man-hours are increased.

One or more embodiments of the present invention provides a low-profile switch having the decreased number of components and the decreased assembly man-hours.

In accordance with one or more embodiments of the present invention, a switch includes: a base, in which a flat circular recess is formed on an upper surface and a fixed contact is disposed in an inner surface of the flat circular recess; a spring body that includes a bellows shape in which a reference form unit is repetitively formed, the spring body being annularly disposed in the flat circular recess of the base; and an operating body that includes a turning unit fitted turnably in the flat circular recess of the base, and an operating projection being provided in an inward surface of the turning unit. In the switch, when the operating body is turned, the operating projection presses an end portion of the spring body to compress the spring body, which allows a contact to be switched.

According to one or more embodiments of the present invention, the spring body having the bellows shape is annularly disposed, and the contact is switched by compressing the spring body. Therefore, the necessity of the use of the coil spring is eliminated to obtain the low-profile switch.

Additionally, the spring body has a spring function and a movable contact function, so that the necessity of the provision of another movable contact can be eliminated to obtain the switch having the decreased number of components and the decreased assembly man-hours.

In the switch, the fixed contact may be disposed in an inside surface of the flat circular recess and/or a bottom surface of the flat circular recess.

Accordingly, the disposition of the fixed contact can be changed as needed basis, and the switch having the increased degree of design freedom is obtained.

In the switch, a first switching fixed contact and a second switching fixed contact may be provided in parallel at a position where the first switching fixed contact and the second switching fixed contact can contact with the spring body during expansion and contraction on one end side of the spring body in the inner surface of the base, a third switching fixed contact and a fourth switching fixed contact may be provided in parallel at a position where the third switching fixed contact and the fourth switching fixed contact can contact with the spring body during the expansion and contraction on the other end side of the spring body, and the first switching fixed contact and the third switching fixed contact may alternately be used as a common fixed contact.

In the switch, a first switching fixed contact and a central fixed contact may be provided at a position where the first switching fixed contact and the central fixed contact can contact with the spring body during expansion and contraction on one end side of the spring body in the inner surface of the base, a second switching fixed contact and the central fixed contact may be provided at a position where the second switching fixed contact and the central fixed contact can contact with the spring body during the expansion and contraction on the other end side of the spring body, and the first switching fixed contact and the second switching fixed contact may alternately be used as a common fixed contact.

In addition to the both end portions of the spring body, a movable contact unit located at a leading end of an elastic arm extending from the spring body may contact with the switching fixed contact.

Accordingly, the first and second switching fixed contacts are alternately used as the common fixed contact according to a turning direction of the operating body, so that the low-profile switch having the simple structure can be obtained.

In the switch, the reference form units adjacent to each other in the spring body may differ from each other in a height of an apex located inside.

Accordingly, because the reference form units adjacent to each other differ from each other in the height, the apexes of the reference form units adjacent to each other do not collide with each other even if the spring body is compressed by the turning operating body, and smooth operation can be performed to obtain the switch having a good operation feeling.

In the switch, at least an apex located inside may be formed into a linear shape in the reference form units adjacent to each other in the spring body.

Accordingly, the spring body is formed by the repetition of the reference form unit including the linear shape, so that the switch having the further increased degree of design freedom can be obtained.

In the switch, a leading end of an elastic arm extending from at least one outside apex may be used as a movable contact in the reference form unit of the spring body.

Accordingly, even if the spring body is elastically deformed outward by the operation of the operating body, the elastic arm absorbs the elastic deformation to control a position. Therefore, the smooth operation feeling is obtained while a desired contact pressure is ensured.

In the switch, an operating lever projecting from the base may extend laterally from an outer circumferential edge portion of the turning unit of the operating body.

Accordingly, the switch that switches the contact through the self-return operating lever can be obtained.

In the switch, an operating shaft may project in a central portion in an outward surface of the turning unit of the operating body.

Accordingly, the switch in which the contact is manually opened and closed by turning the operating shaft using, for example, a dial can be obtained.

In the switch, an operating recess may be provided in the central portion in the outward surface of the turning unit of the operating body.

Accordingly, the switch, in which the contact is opened and closed with a slotted screwdriver by providing, for example, a single thread groove as the operating recess or the contact is opened and closed with a hexagonal wrench or a hexagonal rod by providing a recess or a through-hole having a hexagonal shape in plane, can be obtained.

DETAILED DESCRIPTION

Embodiments of the present invention will be described with reference to FIGS. 1 to 12. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1A:
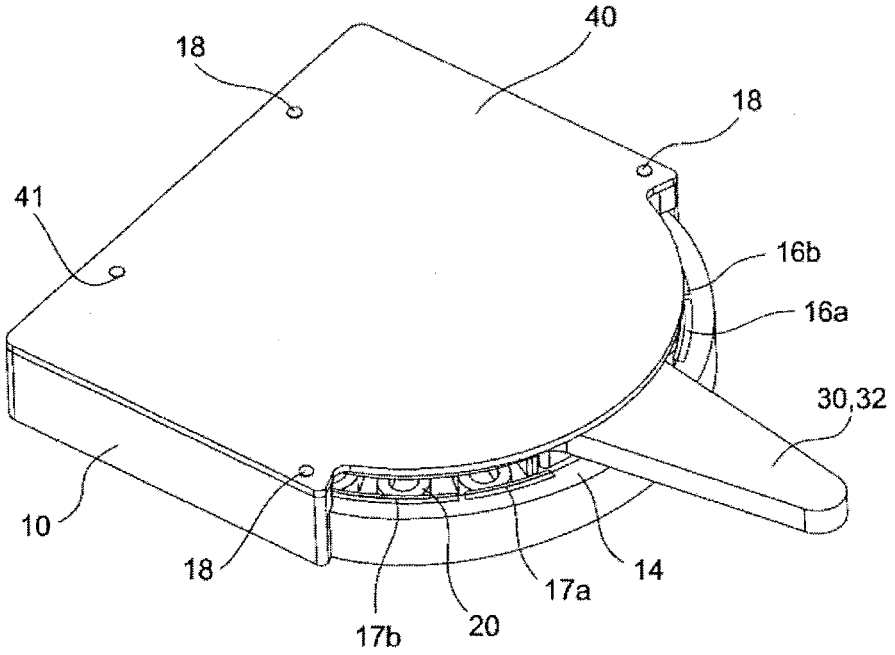
FIGS. 1A and 1B are a perspective view and a perspective transparent view of a switch according to a first embodiment of the present invention.
Figure 1B:
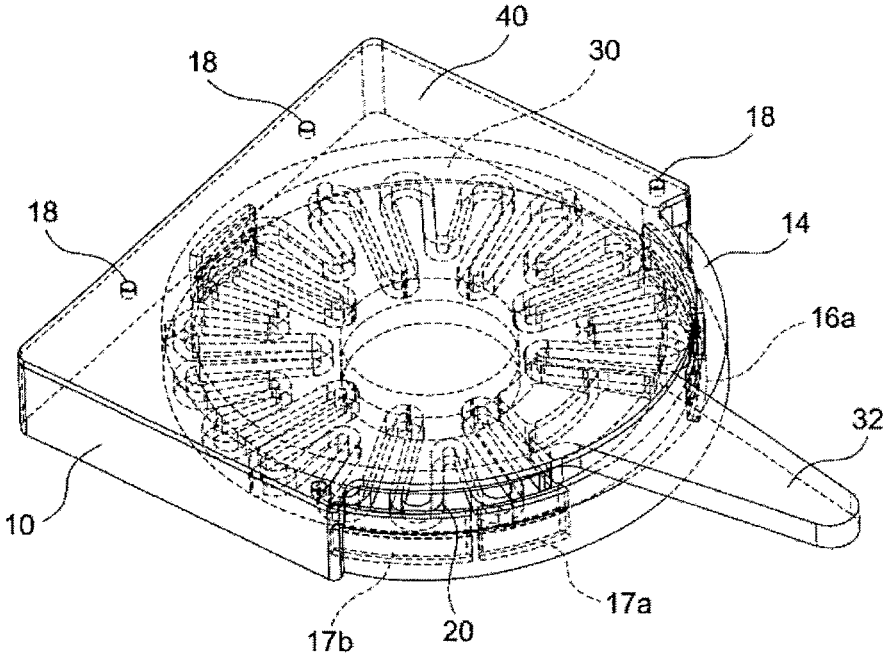
Figure 2A:
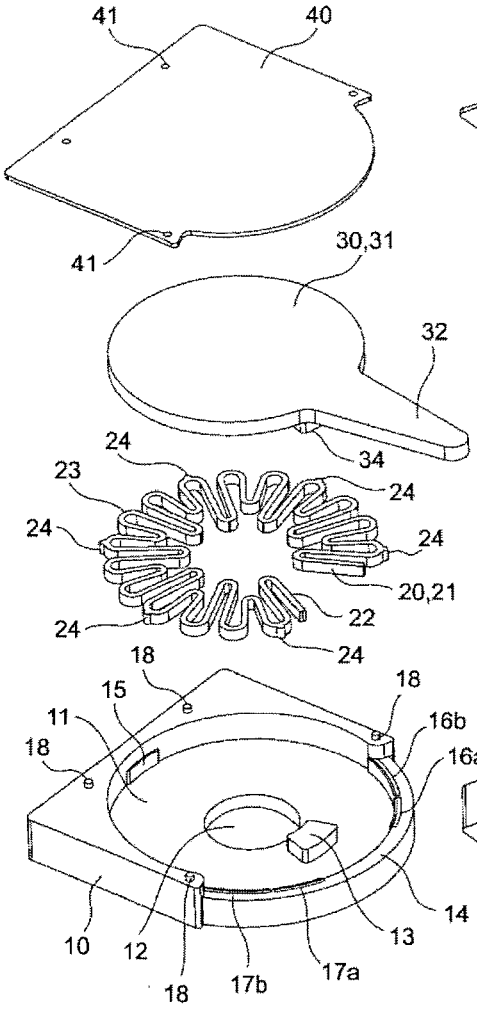
FIGS. 2A and 2B are an exploded perspective view of the switch in FIG. 1A and a perspective view of the switch when viewed from a different angle.
Figure 2B:
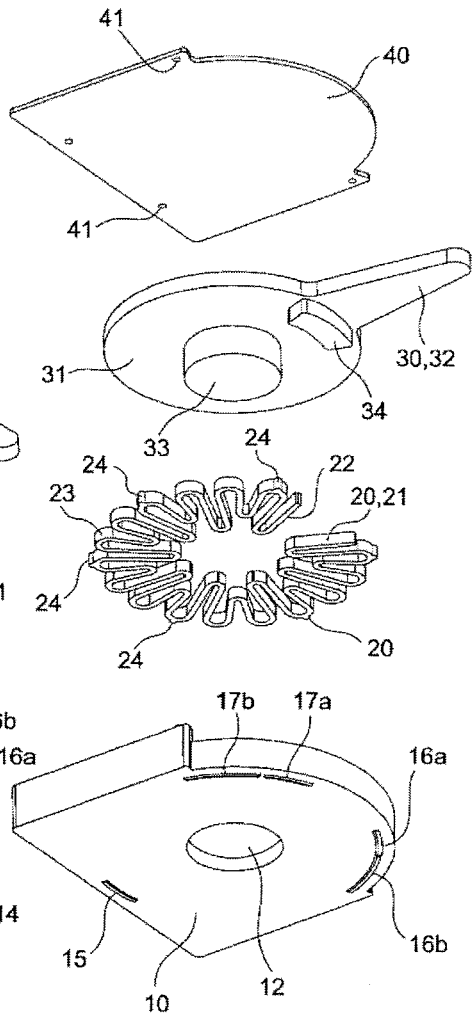
Figure 3A:
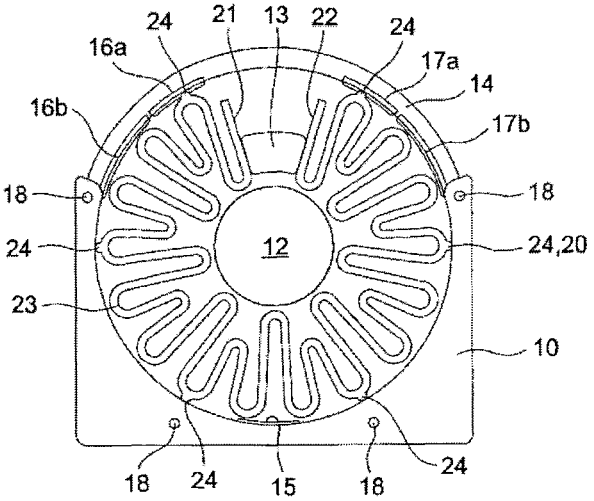
FIG. 3A is a plan view illustrating a state in which a cover and an operating lever are detached.

As illustrated in FIGS. 1 to 3, a switch according to a first embodiment includes a base 10, a spring body 20, an operating body 30, and a cover 40.

As illustrated in FIGS. 2A-2B, a shaft hole 12 is made in the center of a flat circular recess 11 provided in an upper surface of the base 10, and a positioning projection 13 projects near the shaft hole 12. An operating step 14 is formed along the flat circular storage recess 11 on one side of the base 10 in order to guide the operating body 30 described later. First and second switching fixed contacts 16*a* and 16*b* and third and fourth switching fixed contacts 17*a* and 17*b* are insert-molded on both sides of a central fixed contact 15 insert-molded in an inside surface of the flat circular storage recess 11.

The spring body 20 has a bellows shape in which a reference form unit 23 is constantly repeated, end portions 21 and 22 of the spring body 20 are symmetrically formed, and waveform shapes having different heights are alternately repeated in the reference form units 23 integral with the end portions 21 and 22. A sliding projection 24 having a semi-circular shape in section projects suitably in a lateral direction at an apex of an outward side surface of the reference form unit 23. The sliding projection 24 is provided such that a frictional resistance against the base 10 is reduced and such that an electric contact is ensured. The section of the spring body 20 has an aspect ratio or at least 1 and, according to one or more embodiments of the present invention, may have an aspect ratio of at least 2. The spring body 20 may be formed by press working or electroforming. As used herein, the aspect ratio means a ratio of a thickness of the spring body 20 and a width of the reference form unit 23.

The spring body 20 is accommodated in the flat circular recess 11 of the base 10, whereby the end portions 21 and 22 of the spring body 20 press-contact with the positioning projection 13 from both sides while the sliding projection 24 contacts linearly with an inside surface of the flat circular recess 11.

The operating body 30 includes a turning unit 31 that can be fitted in the flat circular recess 11 of the base 10, and an operating lever 32 extends laterally from the turning unit 31. A shaft 33 projects in a central portion of a lower surface of the turning unit 31, and an operating projection 34 projects near the shaft 33.

The shaft 33 of the operating body 30 is fitted in the shaft hole 12 of the base 10, whereby both the sides of the operating projection 34 are biased from the end portions 21 and 22 of the spring body 20 while the operating lever 32 can slide along the operating step 14 of the base 10.

The cover 40 has a planar shape that can cover the base 10. A caulking projection 18 of the base 10 is fitted in a caulking hole 41 to melt the caulking projection 18, whereby the caulking projection 18 and the caulking hole 41 are integrally bonded to prevent falls of the spring body 20 and the operating body 30.

Motion of switch having the above configuration will be described below. For example, it is conceivable that the switch of the first embodiment is applied to the case that a zoom speed is switched from a normal speed to a high speed in a zoom mechanism of a DVD camera.

Figure 3B:
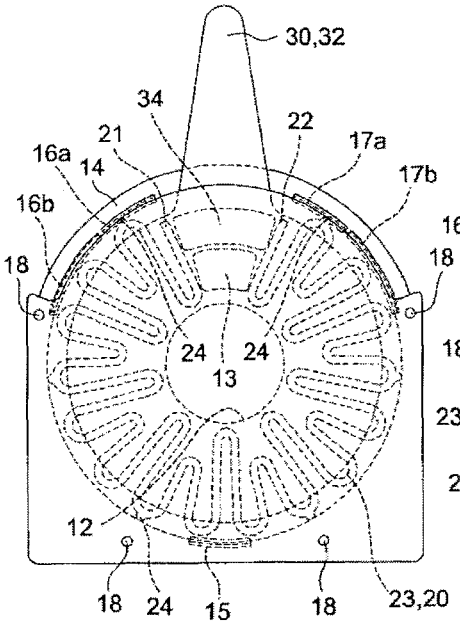
FIGS. 3B and 3C are plan transparent views illustrating before-and-after motions.

As illustrated in FIG. 3B, in the case that the operating lever 32 of the operating body 30 is not operated, the sliding projection 24 located near the side of the end portion 21 press-contacts with the first switching fixed contact 16*a* while the sliding projection 24 located near the side of the end portion 22 press-contacts with the third switching fixed contact 17*a*. However, the sliding projection 24 located near the central fixed contact 15 does not contact with the central fixed contact 15.

Figure 3C:
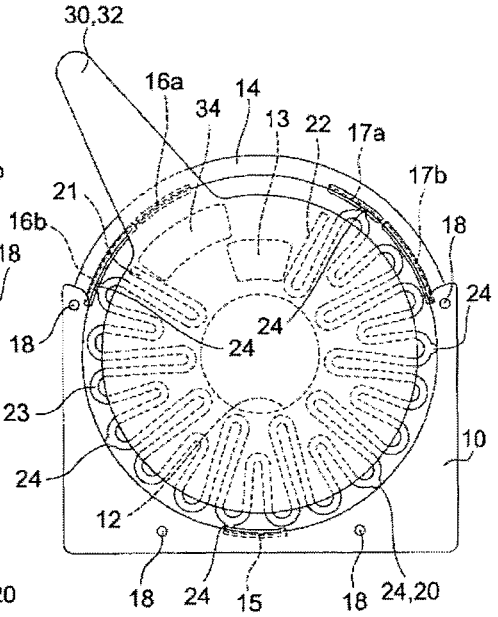

As illustrated in FIG. 3C, when the operating lever 32 of the operating body 30 is turned counterclockwise along the operating step 14, the operating projection 34 presses the end portion 21 of the spring body 20 to compress the spring body 20, which allows the sliding projection 24 located near the side of the end portion 21 to be switched from the first switching fixed contact 16*a* to the second switching fixed contact 16*b*. At this point, the sliding projection 24 located near the side of the end portion 22 of the spring body 20 remains in contact with the third switching fixed contact 17*a*. Therefore, electrical conduction between the second switching fixed contact 16*b* and the third switching fixed contact 17*a* is established through the spring body 20. At this point, the zoom of a lens of the DVD camera is performed at the normal speed.

When the operating body 30 is further turned, the sliding projection 24 located in the center of the spring body 20 contacts with the central fixed contact 15 to establish the electrical conduction with the central fixed contact 15 while the third switching fixed contact 17*a* remains in electrical conduction with the second switching fixed contact 16*b*. Therefore, the zoom of the lens of the DVD camera is performed at the high speed compared with the normal speed. Accordingly, the third switching fixed contact 17*a* acts as a common fixed contact.

When an operating force of the operating body 30 is released, the operating body 30 self-returns to an original state by a spring force of the spring body 20. Therefore, the lens of the DVD camera also returns to the original state.

The contact is similarly switched in the case that the operating body 30 is turned clockwise. Accordingly, the first switching fixed contact 16*a* and the third switching fixed contact 17*a* act alternately as the common fixed contact.

According to the first embodiment, a recess and a projection are alternately provided in the apexes inside the repetitive waveform shape in the reference form unit 23 of the spring body 20. This is because the apexes adjacent to each other do not collide with each other in the case that the spring body 20 is operated by the operating body 30. As a result, in the first embodiment, advantageously the switch that has a smooth operation feeling even if the spring body 20 is compressed can be obtained.

Figure 4A:
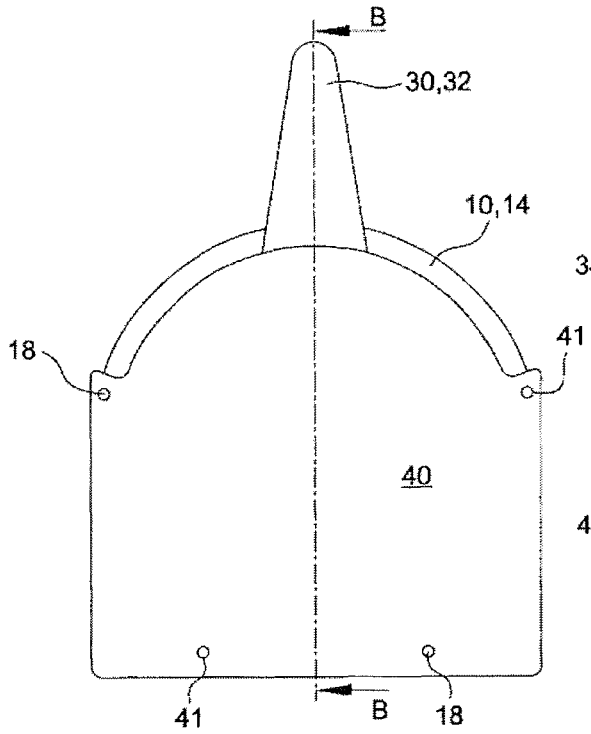
FIG. 4A is a plan view illustrating a switch according to a second embodiment of the present invention.
Figure 4B:
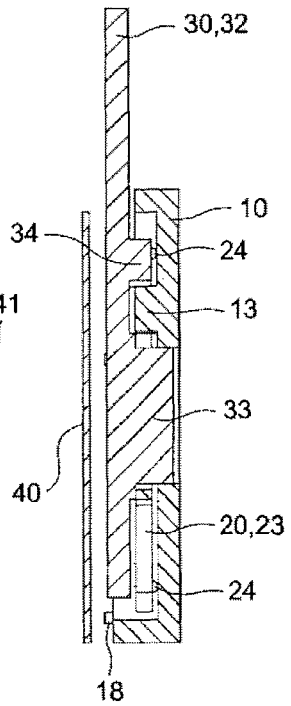
FIG. 4B is a sectional view taken on a line B-B of FIG. 4A.
Figure 4C:
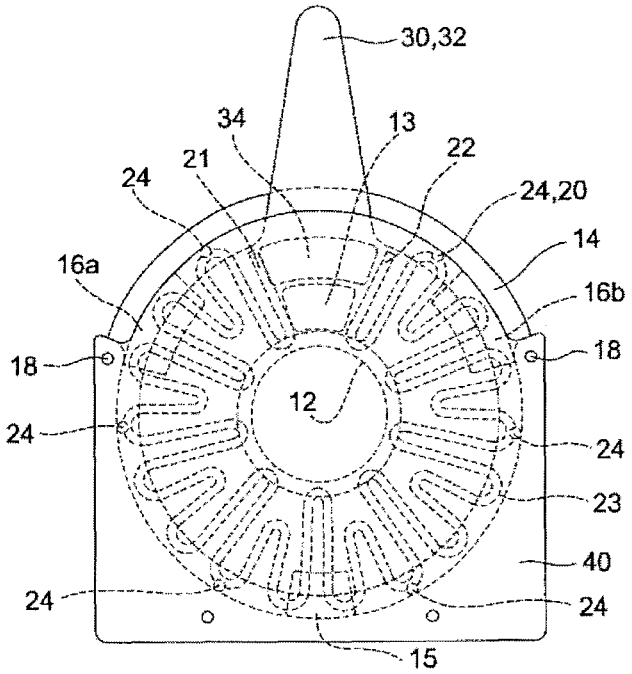
FIG. 4C is a plan transparent view of FIG. 4A.

As illustrated in FIGS. 4 and 5, similarly to the first embodiment, a switch according to a second embodiment includes the base 10, the spring body 20, the operating body 30, and the cover 40.

Figure 5A:
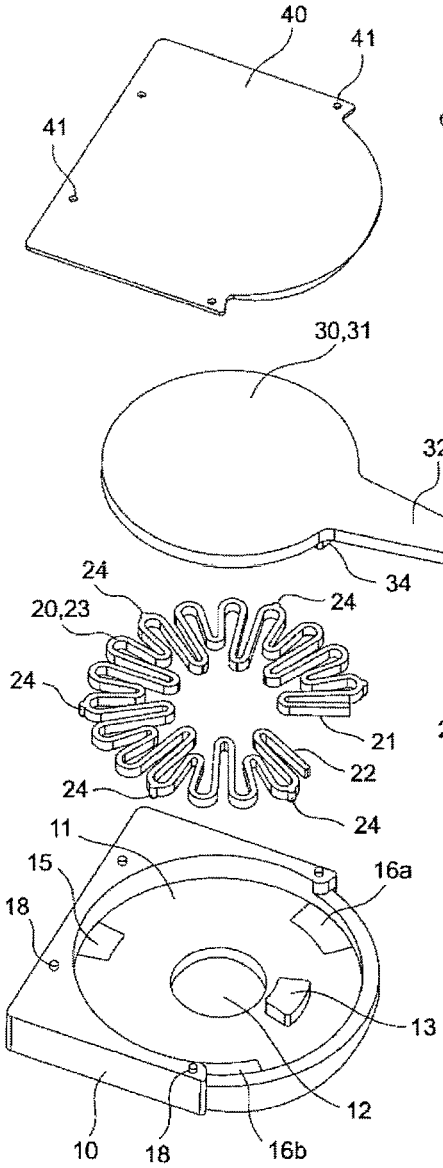
FIG. 5A is a perspective view of the switch in FIG. 4A.
Figure 5B:
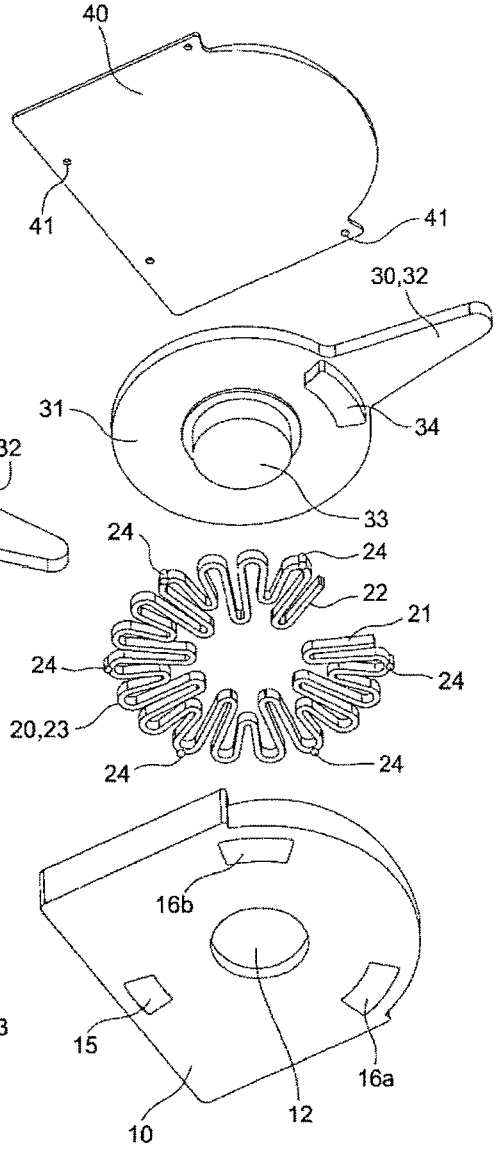
FIG. 5B is a perspective view of the switch when viewed from a different angle.

Particularly, as illustrated in FIGS. 5A-5B, the base 10 differs from that of the first embodiment in that the central fixed contact 15 is provided in a corner portion of the bottom surface of the flat circular recess 11 and that the first switching fixed contact 16*a* and the second switching fixed contact 16*b* are provided in the bottom surface on both the sides of the central fixed contact 15.

The spring body 20 differs from that of the first embodiment in that the sliding projection 24 projects downwardly and laterally. The reason the sliding projection 24 projects laterally is that the frictional resistance generated during the sliding is reduced. The reason the sliding projection 24 projects downwardly is that the movable contact that contacts surely with the central fixed contact 15, the first switching fixed contact 16*a*, and the second switching fixed contact 16*b* is obtained.

Because other configurations are similar to those of the first embodiment, the same component is designated by the same numeral, and the description is neglected.

According to the second embodiment, the fixed contact is disposed in the bottom surface of the flat circular recess 11, so that a degree of design freedom of the terminal can be increased to facilitate optimum design of the insert molding or a die. Particularly, because the terminal is insert-molded in the bottom surface of the base, advantageously a mechanical strength is increased.

Figure 6A:
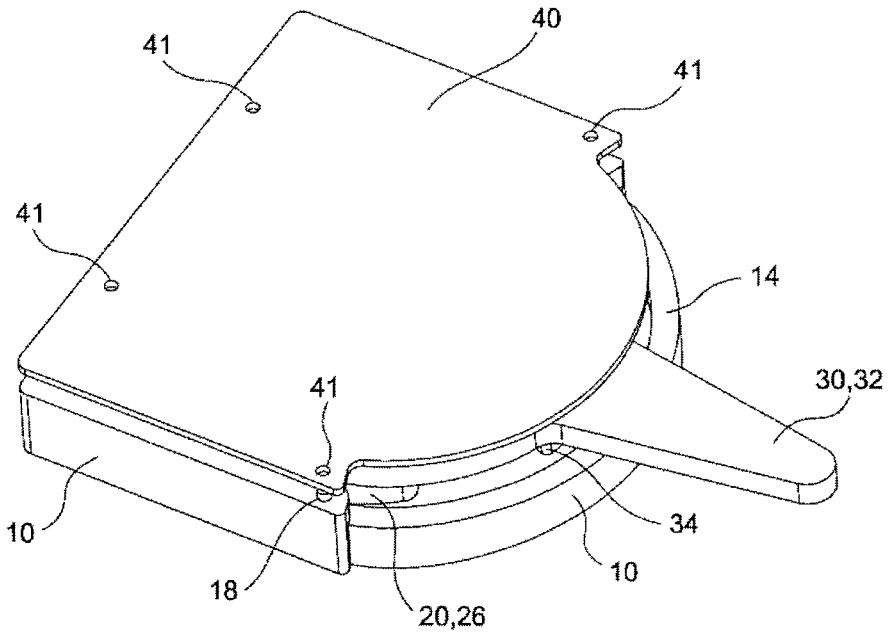
FIGS. 6A and 6B are a perspective view and a perspective transparent view of a switch according to a third embodiment of the present invention.
Figure 6B:
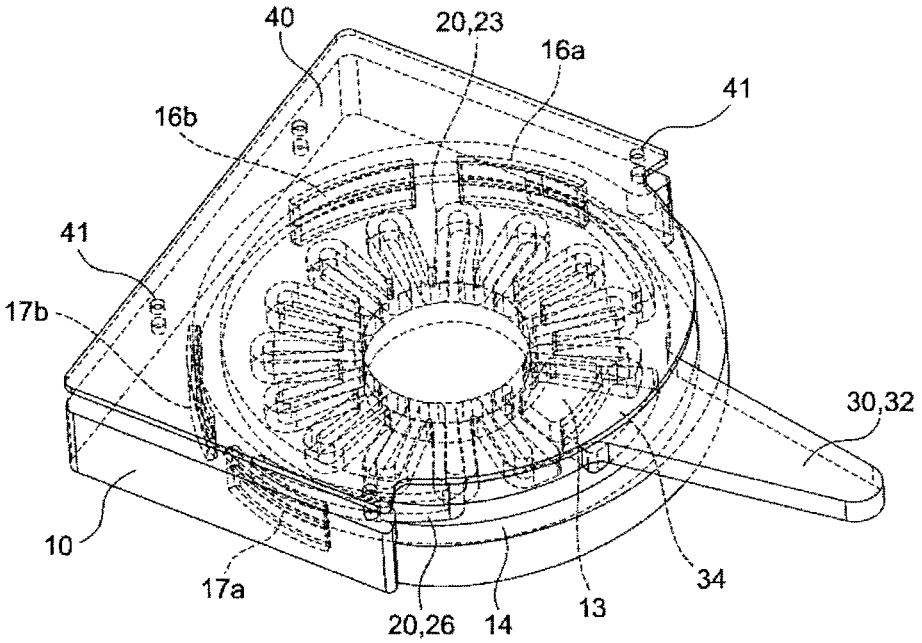

As illustrated in FIGS. 6 to 8, similarly to the first embodiment, a switch according to a third embodiment includes the base 10, the spring body 20, the operating body 30, and the cover 40.

Figure 7A:
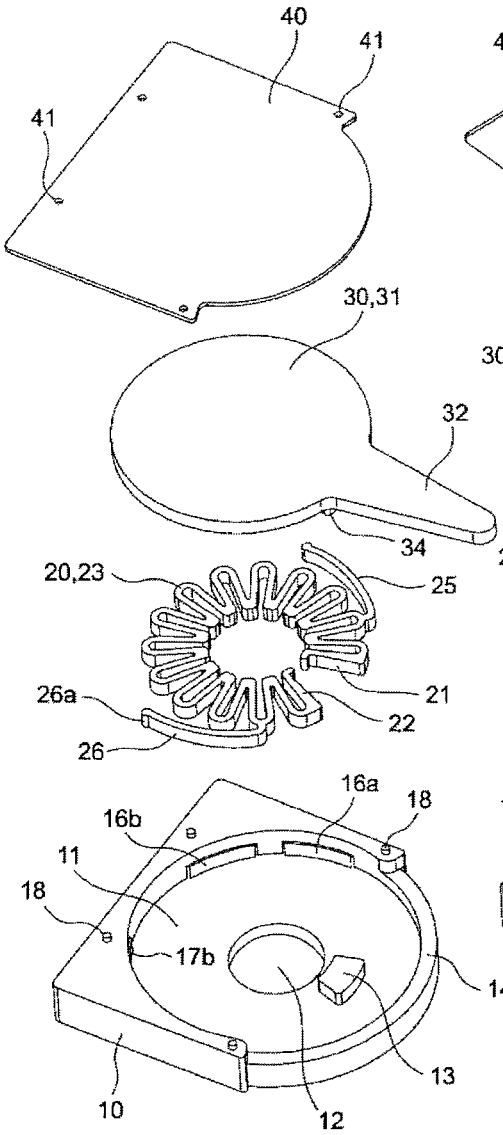
FIGS. 7A and 7B are an exploded perspective view of the switch in FIG. 6A and a perspective view of the switch when viewed from a different angle.
Figure 7B:
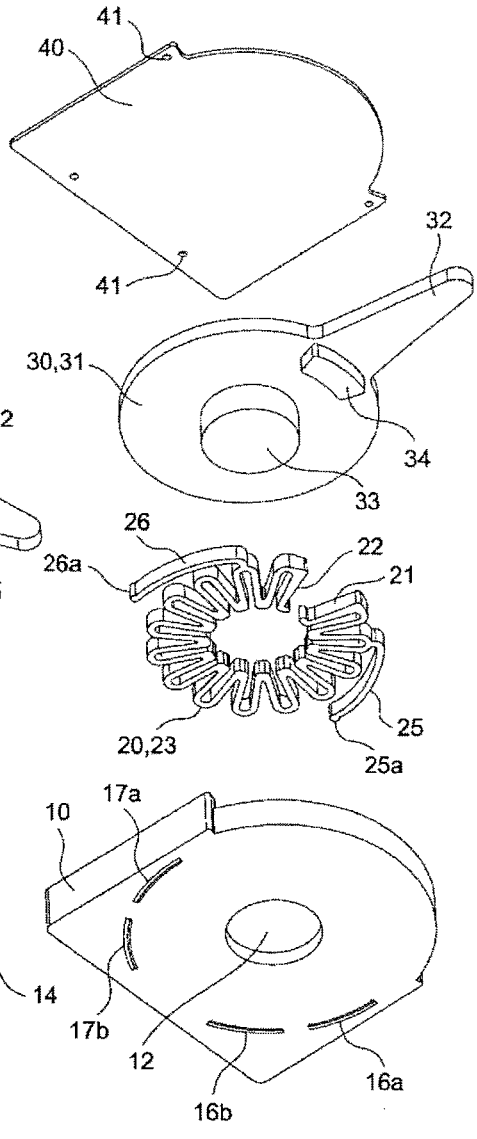

As illustrated in FIGS. 7A-7B, the base 10 differs from that of the first embodiment in that the first and second switching fixed contacts 16*a* and 16*b* and the third and fourth switching fixed contacts 17*a* and 17*b* are bilaterally symmetrically insert-molded in the inside surface of the flat circular recess 11 of the base 10.

Similarly to the first embodiment, the spring body 20 has the bellows shape in which the reference form unit 23 is constantly repeated, and the end portions 21 and 22 of the spring body 20 having symmetrical shape include pawl portions that engages with the positioning projection 13. In the reference form units 23 integral with the end portions 21 and 22, the waveform shapes having the same height are alternately repeated. In the outer side surface of the reference form unit 23, arc elastic arms 25 and 26 extend laterally in the apexes located near the end portions 21 and 22, and the leading ends of the arc elastic arms 25 and 26 constitute movable contact units 25*a* and 26*a*.

Figure 8A:
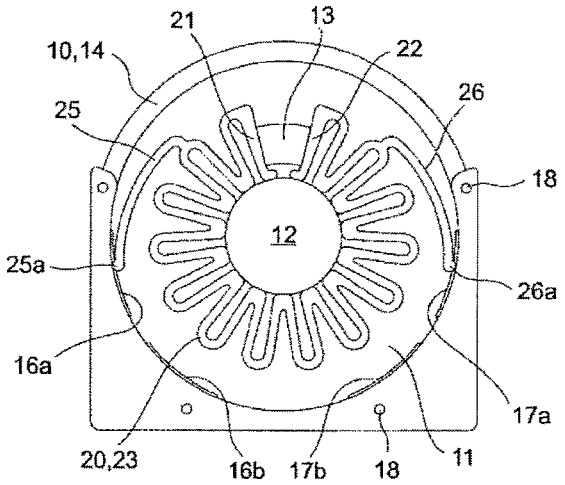
FIG. 8A is a plan view illustrating the state in which the cover and the operating lever are detached.

Therefore, as illustrated in FIG. 8A, the spring body 20 is fitted in the flat circular recess 11 of the base 10, which allows the movable contacts 25*a* and 26*a* of the elastic arms 25 and 26 to contact with the first and second switching fixed contacts 16*a* and 16*b* and the third and fourth switching fixed contacts 17*a* and 17*b*.

The reference form unit 23 does not contact with the inside surface of the flat circular recess 11 before the operation, but the reference form unit 23 may come close to and contact with the inside surface of the flat circular recess 11 as the operating body 30 is turned.

The number of elastic arms may be one or at least three.

Because other configurations are similar to those of the first embodiment, the same component is designated by the same numeral, and the description is neglected.

The operation of the switch having the above configuration will be described below.

Figure 8B:
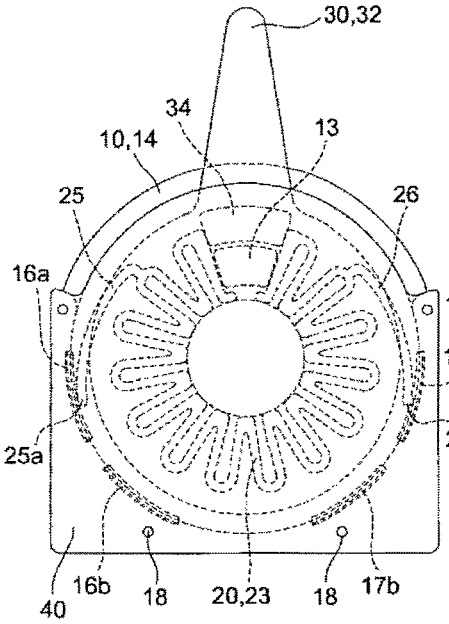
FIGS. 8B and 8C are plan transparent views illustrating the before-and-after motions.

As illustrated in FIG. 8B, in the case that the operating lever 32 of the operating body 30 is not performed, the movable contact 25*a* press-contacts with the first switching fixed contact 16*a* while the movable contact 26*a* press-contacts with the third switching fixed contact 17*a*.

Figure 8C:
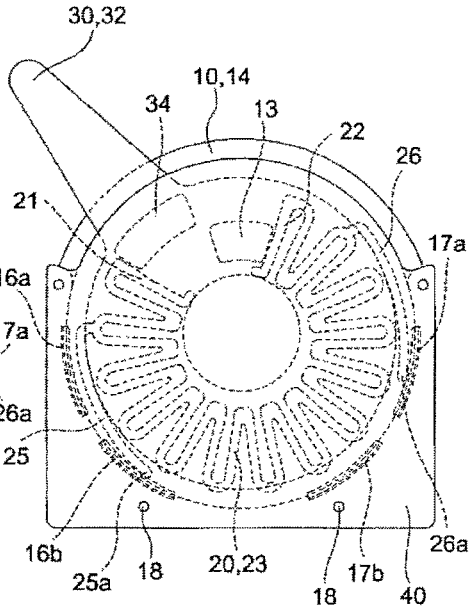

As illustrated in FIG. 8C, when the operating lever 32 of the operating body 30 is turned counterclockwise along the operating step 14, the operating projection 34 presses the end portion 21 of the spring body 20 to compress the spring body 20. Therefore, the movable contact 25*a* is switched from the first switching fixed contact 16*a* to the second switching fixed contact 16*b*. At this point, the movable contact 26*a* of the spring body 20 remains in contact with the third switching fixed contact 17*a*. As a result, the electrical conduction between the second switching fixed contact 16*a* and the third switching fixed contact 17*a* is established through the spring body 20. When the operating force of the operating body 30 is released, the operating body 30 self-returns to the original state by the spring force of the spring body 20.

The contact is similarly switched in the case that the operating body 30 is turned clockwise.

According to the third embodiment, because the elastic arms 25 and 26 are provided in the spring body 20, even if the spring body 20 is elastically deformed outward by the operation of the operating body 30, elastic deformations of the elastic arms 25 and 26 absorb the elastic deformation to control the position. Therefore, in the third embodiment, the smooth operation feeling is obtained while a desired contact pressure is ensured.

Figure 9A:
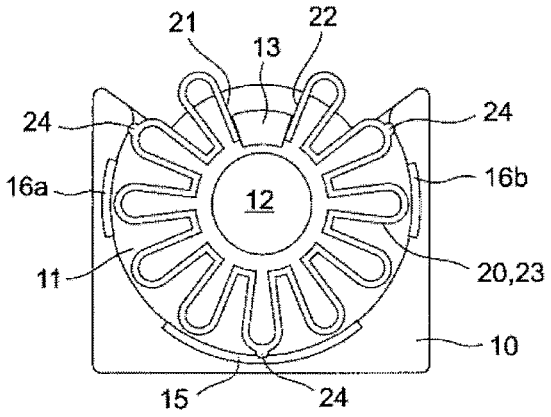
FIG. 9A is a plan view illustrating a switch according to a fourth embodiment of the present invention and the state in which the cover and the operating lever are detached.
Figure 9B:
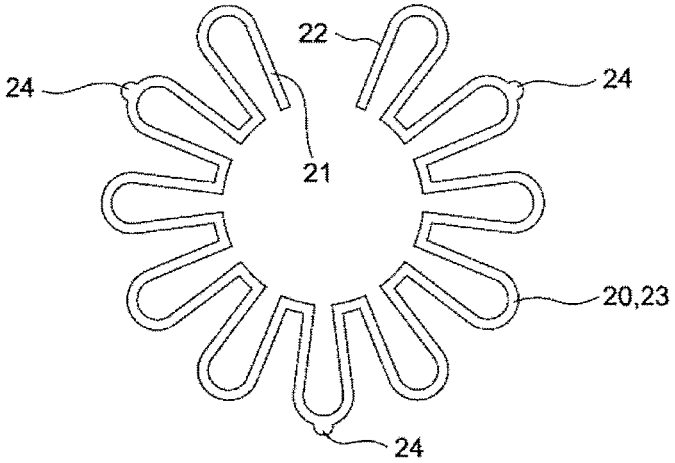
FIGS. 9B and 9C are a plan view and a perspective view of a spring body in FIG. 9A.
Figure 9C:
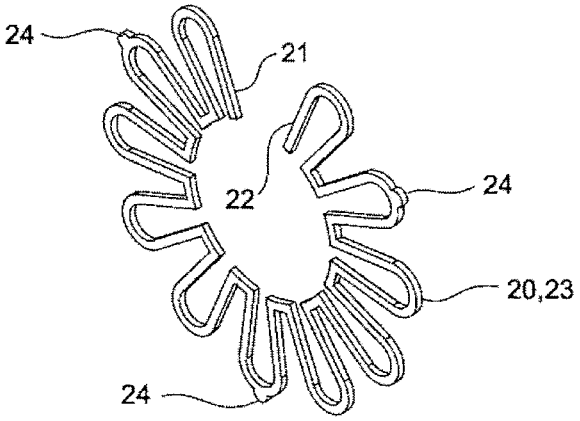

As illustrated in FIGS. 9A-9C, a switch according to a fourth embodiment differs from those of the first to third embodiments in that the inside apex is linearly formed in the reference form unit 23 of the spring body 20.

According to the fourth embodiment, because the inside apex is linearly formed, the design is easily performed because of the simple shape, and the degree of design freedom is increased.

Additionally, the first and third switching fixed contacts 16*a* and 17*a* act advantageously as the common fixed contact.

Because other configurations are similar to those of the first embodiment, the same component is designated by the same numeral, and the description is neglected.

Figure 10A:
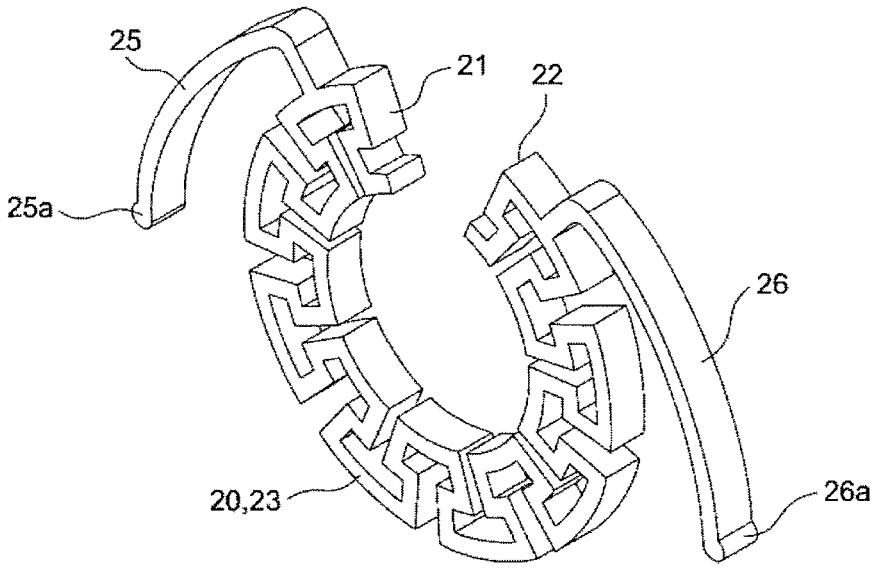
FIGS. 10A and 10B are a perspective view and a plan view of the spring body used in a switch according to a fifth embodiment of the present invention.
Figure 10B:
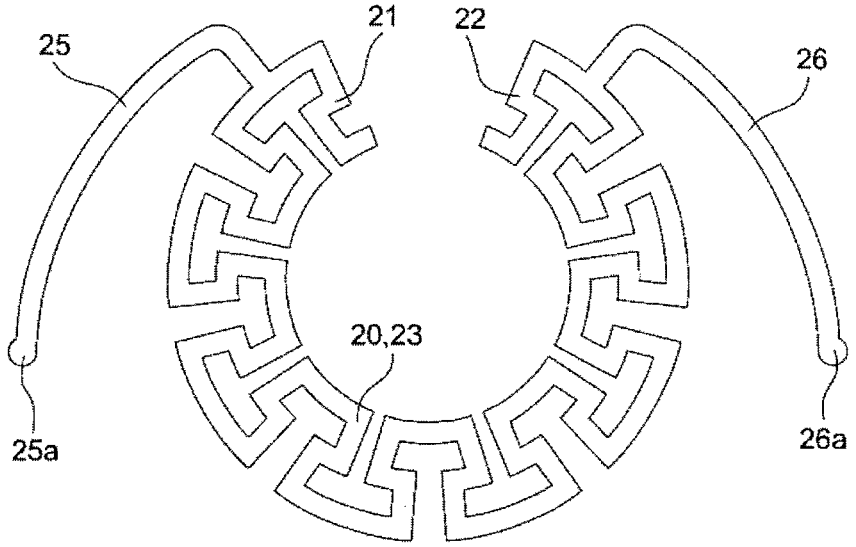

As illustrated in FIGS. 10A-10B, a switch according to a fifth embodiment differs from that of the first embodiment in the shape of the spring body 20.

The reference form unit 23 of the spring body 20 is formed into the bellows shape in which a pattern based on a straight line is repeated, and the arc elastic arms 25 and 26 extend from the apexes located near the end portions 21 and 22.

Because other configurations are similar to those of the first embodiment, the same component is designated by the same numeral, and the description is neglected.

According to the fifth embodiment, advantageously a degree of design freedom is increased.

Figure 11A:
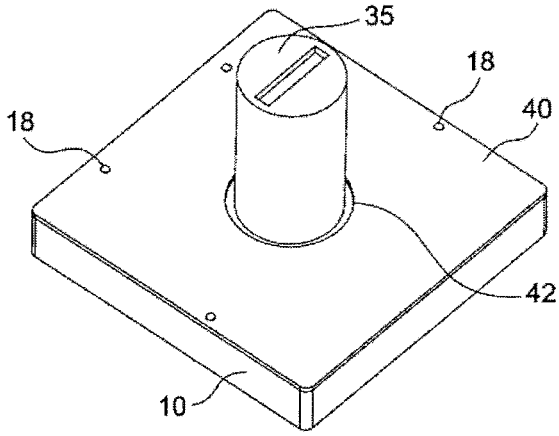
FIGS. 11A and 11B are a perspective view and an exploded perspective view of a switch according to a sixth embodiment of the present invention.
Figure 11B:
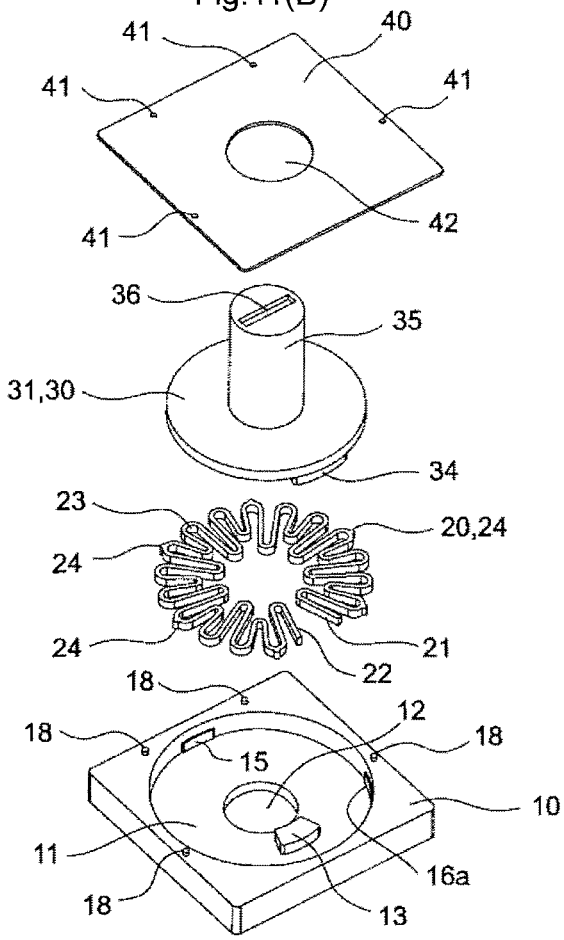

As illustrated in FIGS. 11A-11B, a switch according to a sixth embodiment differs from that of the first embodiment in that an operating shaft 35 projecting from an operation hole 42 of the cover 40 projects in the central portion of an outward surface of the turning unit 31 of the operating body 30. A single thread groove 36 that can be operated with a slotted screwdriver (not illustrated) is provided in a leading end surface of the operating shaft 35.

Because other configurations are similar to those of the first embodiment, the same component is designated by the same numeral, and the description is neglected.

According to the sixth embodiment, advantageously a selection range of the method for operating the operating body is widened to extend the use of the switch.

Figure 12A:
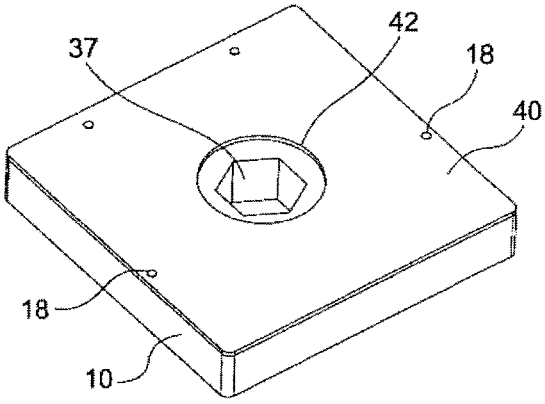
FIGS. 12A and 12B are a perspective view and an exploded perspective view of a switch according to a seventh embodiment of the present invention.
Figure 12B:
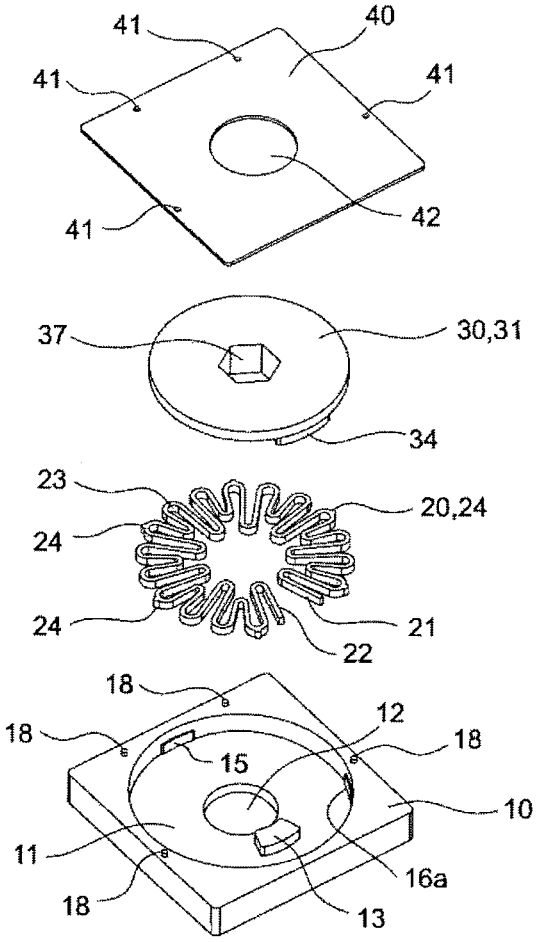

As illustrated in FIGS. 12A-12B, a switch according to a seventh embodiment differs from that of the first embodiment in that a hexagonal recess 37 having a hexagonal shape in plane is provided in the central portion in the outward surface of the turning unit 31 of the operating body 30. The hexagonal recess 37 can be operated from the operation hole 42 of the cover 40. The hexagonal recess 37 can be operated by inserting a hexagonal wrench (not illustrated) in the hexagonal recess 37. The hexagonal recess 37 is not limited to the simply recessed shape, but the hexagonal recess 37 includes the through-hole.

Because other configurations are similar to those of the first embodiment, the same component is designated by the same numeral, and the description is neglected.

According to the seventh embodiment, advantageously the selection range of the method for operating the operating body is widened to extend the use of the switch.

The bellows shape of the reference form unit 23 of the spring body 20 according to one or more embodiments of the present invention means not only the shape formed by repeating the simple waveform shape, but also the shape formed by the same pattern repeated.

In a free state before the spring body is assembled in the base 10, the spring body may have the linear shape or the spring body may have the arc shape.

The fixed contact may properly be disposed in the inside surface and/or the bottom surface of the flat circular recess.

The reference form unit is not limited to the substantial U-shape like the above embodiments, but various shapes of the reference form unit can be selected as needed basis.

The switch of the present invention is not limited to the above shapes, but the switch may include the spring body having another bellows shape.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

10 base
11 flat circular recess
12 shaft hole
13 positioning projection
14 operating step
15 central fixed contact
16*a*, 16*b* first and second switching fixed contacts
17*a*, 17*b* third and fourth switching fixed contacts
18 caulking projection
20 spring body
21 end portion
22 end portion
23 reference form unit
24 sliding projection
25, 26 elastic arm
25*a*, 26*a* movable contact
30 operating body
31 turning unit
32 operating lever
33 shaft
34 operating projection
35 operating shaft
37 operating recess
40 cover
41 caulking hole
42 operation hole

The invention claimed is:

1. A switch comprising:

a base comprising a flat circular recess formed on an upper surface thereof;

a fixed contact disposed in an inner surface of the flat circular recess;

a spring body that comprises a bellows shape in which a reference form unit is repetitively formed, the spring body being annularly disposed in the flat circular recess of the base;

an operating body that comprises a turning unit fitted turnably in the flat circular recess of the base; and an operating projection provided in an inward surface of the turning unit, wherein, when the operating body is turned, the operating projection presses an end portion of the spring body to compress the spring body, which allows a contact to be switched, and wherein the reference form units adjacent to each other in the spring body differ from each other in a height of an apex located inside.

2. The switch according to claim 1, wherein the fixed contact is disposed on an inside surface of the flat circular recess.

3. The switch according to claim 1, wherein the fixed contact is disposed on a bottom surface of the flat circular recess.

4. The switch according to claim 1, wherein a first switching fixed contact and a second switching fixed contact are provided in parallel at a position where the first switching fixed contact and the second switching fixed contact can contact with the spring body during expansion and contraction on one end side of the spring body in the inner surface of the base, wherein a third switching fixed contact and a fourth switching fixed contact are provided in parallel at a position where the third switching fixed contact and the fourth switching fixed contact can contact with the spring body during the expansion and contraction on the other end side of the spring body, and wherein the first switching fixed contact and the third switching fixed contact are alternately used as a common fixed contact.

5. The switch according to claim 1, wherein a first switching fixed contact and a central fixed contact are provided at a position where the first switching fixed contact and the central fixed contact can contact with the spring body during expansion and contraction on one end side of the spring body in the inner surface of the base, wherein a second switching fixed contact and the central fixed contact are provided at a position where the second switching fixed contact and the central fixed contact can contact with the spring body during the expansion and contraction on the other end side of the spring body, and wherein the first switching fixed contact and the second switching fixed contact are alternately used as a common fixed contact.

6. The switch according to claim 1, wherein an operating lever projecting from the base extends laterally from an outer circumferential edge portion of the turning unit of the operating body.

7. The switch according to claim 1, wherein an operating shaft projects in a central portion in an outward surface of the turning unit of the operating body.

8. The switch according to claim 1, wherein an operating recess is provided in the central portion in the outward surface of the turning unit of the operating body.

9. The switch according to claim 2, wherein the fixed contact is disposed on a bottom surface of the flat circular recess.

10. The switch according to claim 2, wherein a first switching fixed contact and a second switching fixed contact are provided in parallel at a position where the first switching fixed contact and the second switching fixed contact can contact with the spring body during expansion and contraction on one end side of the spring body in the inner surface of the base, wherein a third switching fixed contact and a fourth switching fixed contact are provided in parallel at a position where the third switching fixed contact and the fourth switching fixed contact can contact with the spring body during the expansion and contraction on the other end side of the spring body, and wherein the first switching fixed contact and the third switching fixed contact are alternately used as a common fixed contact.

11. The switch according to claim 3, wherein a first switching fixed contact and a second switching fixed contact are provided in parallel at a position where the first switching fixed contact and the second switching fixed contact can contact with the spring body during expansion and contraction on one end side of the spring body in the inner surface of the base, wherein a third switching fixed contact and a fourth switching fixed contact are provided in parallel at a position where the third switching fixed contact and the fourth switching fixed contact can contact with the spring body during the expansion and contraction on the other end side of the spring body, and wherein the first switching fixed contact and the third switching fixed contact are alternately used as a common fixed contact.

12. The switch according to claim 2, wherein a first switching fixed contact and a central fixed contact are provided at a position where the first switching fixed contact and the central fixed contact can contact with the spring body during expansion and contraction on one end side of the spring body in the inner surface of the base, wherein a second switching fixed contact and the central fixed contact are provided at a position where the second switching fixed contact and the central fixed contact can contact with the spring body during the expansion and contraction on the other end side of the spring body, and wherein the first switching fixed contact and the second switching fixed contact are alternately used as a common fixed contact.

13. The switch according to claim 3, wherein a first switching fixed contact and a central fixed contact are provided at a position where the first switching fixed contact and the central fixed contact can contact with the spring body during expansion and contraction on one end side of the spring body in the inner surface of the base, wherein a second switching fixed contact and the central fixed contact are provided at a position where the second switching fixed contact and the central fixed contact can contact with the spring body during the expansion and contraction on the other end side of the spring body, and wherein the first switching fixed contact and the second switching fixed contact are alternately used as a common fixed contact.

14. A switch comprising:

a base comprising a flat circular recess formed on an upper surface thereof;

a fixed contact disposed in an inner surface of the flat circular recess;

a spring body that comprises a bellows shape in which a reference form unit is repetitively formed, the spring body being annularly disposed in the flat circular recess of the base;

an operating body that comprises a turning unit fitted turnably in the flat circular recess of the base; and an operating projection provided in an inward surface of the turning unit, wherein, when the operating body is turned, the operating projection presses an end portion of the spring body to compress the spring body, which allows a contact to be switched, and wherein a leading end of an elastic arm extending from at least one outside apex is used as a movable contact in the reference form unit of the spring body.

15. A switch comprising:

a base comprising a flat circular recess formed on an upper surface thereof;

a fixed contact disposed in an inner surface of the flat circular recess;

a spring body that comprises a bellows shape in which a reference form unit is repetitively formed, the spring body being annularly disposed in the flat circular recess of the base;

an operating body that comprises a turning unit fitted turnably in the flat circular recess of the base; and an operating projection provided in an inward surface of the turning unit, wherein, when the operating body is turned, the operating projection presses an end portion of the spring body to compress the spring body, which allows a contact to be switched, and wherein at least an apex located inside is formed into a linear shape in the reference form units adjacent to each other in the spring body.

16. The switch according to claim 15, wherein the fixed contact is disposed on an inside surface of the flat circular recess.

17. The switch according to claim 15, wherein the fixed contact is disposed on a bottom surface of the flat circular recess.

18. The switch according to claim 15, wherein a first switching fixed contact and a second switching fixed contact are provided in parallel at a position where the first switching fixed contact and the second switching fixed contact can contact with the spring body during expansion and contraction on one end side of the spring body in the inner surface of the base, wherein a third switching fixed contact and a fourth switching fixed contact are provided in parallel at a position where the third switching fixed contact and the fourth switching fixed contact can contact with the spring body during the expansion and contraction on the other end side of the spring body, and wherein the first switching fixed contact and the third switching fixed contact are alternately used as a common fixed contact.

19. The switch according to claim 15, wherein a first switching fixed contact and a central fixed contact are provided at a position where the first switching fixed contact and the central fixed contact can contact with the spring body during expansion and contraction on one end side of the spring body in the inner surface of the base, wherein a second switching fixed contact and the central fixed contact are provided at a position where the second switching fixed contact and the central fixed contact can contact with the spring body during the expansion and contraction on the other end side of the spring body, and wherein the first switching fixed contact and the second switching fixed contact are alternately used as a common fixed contact.

20. The switch according to claim 15, wherein an operating lever projecting from the base extends laterally from an outer circumferential edge portion of the turning unit of the operating body.

* * * * *